US007268754B2

(12) United States Patent
Tsai et al.

(10) Patent No.: US 7,268,754 B2
(45) Date of Patent: Sep. 11, 2007

(54) AM-OEL DISPLAY, ELECTRONIC SYSTEM COMPRISING THE AM-OEL DISPLAY AND A TESTING METHOD THEREOF

(75) Inventors: Shan-Hung Tsai, Taichung (TW); Ming-Hsien Sun, Taipei (TW); An Shih, Changhua (TW)

(73) Assignee: TPO Displays Corp., Chu-Nan (TW)

( * ) Notice: Subject to any disclaimer, the term of this patent is extended or adjusted under 35 U.S.C. 154(b) by 708 days.

(21) Appl. No.: 10/831,400

(22) Filed: Apr. 23, 2004

(65) Prior Publication Data

US 2004/0212571 A1 Oct. 28, 2004

(30) Foreign Application Priority Data

Apr. 23, 2003 (TW) ..... 92109451 A

(51) Int. Cl.
*G09G 5/00* (2006.01)

(52) U.S. Cl. ..... 345/82; 345/76

(58) Field of Classification Search ..... 345/76, 345/77, 78, 79, 80, 81, 82, 904; 324/770
See application file for complete search history.

(56) References Cited

U.S. PATENT DOCUMENTS 6,703,856 B2 * 3/2004 Fujita ..... 324/770
6,914,448 B2 * 7/2005 Jinno ..... 324/769
7,071,932 B2 * 7/2006 Libsch et al. ..... 345/211

* cited by examiner

*Primary Examiner*—Richard Hjerpe
*Assistant Examiner*—Jean Lesperance
(74) *Attorney, Agent, or Firm*—Liu & Liu

(57) ABSTRACT

A pixel testing method is provided. The pixel testing method is adapted to measure device parameters within each pixel of a display. Before plating a lighting device into each pixel, a capacitor is formed such that one end of the capacitor is connected to an open-circuit terminal of an electronic device while the other end of the capacitor is connected to an added common line (or the original scan line or data line of the display). The parameters of the electronic device connected to the lighting device are tested through a charging/discharging of the capacitor so that all the devices within a pixel can be tested before forming organic functional layer in every pixel.

14 Claims, 3 Drawing Sheets

AM-OEL DISPLAY, ELECTRONIC SYSTEM COMPRISING THE AM-OEL DISPLAY AND A TESTING METHOD THEREOF

CROSS-REFERENCE TO RELATED APPLICATION

This application claims the priority benefit of Taiwan application serial no. 92109451, filed on Apr. 23, 2003.

BACKGROUND OF THE INVENTION

1. Field of the Invention

The present invention relates to a method of testing performance or functionality of a pixel circuit device within a display. More particularly, the present invention relates to a method of testing performance of a pixel within a display before forming a lighting device in the pixel.

2. Description of the Related Art

One of the earliest recordings of dynamic images can be found in documentary movies. Later on, when the cathode ray tube (CRT) was invented, television is brought into each family. With the advent of the computer age, CRT is adopted as a display monitor for the desktop computer. Despite its popularity, the radiation gun design always poses some hazard to human health and increases the bulk of each unit. Thus, less bulky and less hazardous alternatives to the CRT are sought.

Flat panel displays are the results of intensive research to reduce size and weight of the display. Many types of displays belong to this category. They include liquid crystal displays (LCDs), field emission displays (FEDs), vacuum fluorescent displays (VFDs), organic light-emitting diodes (OLEDs) and plasma display panels (PDPs).

Organic light-emitting diode display is a type of self-illuminating display also commonly referred to as organic electroluminescence displays (OELs). Major characteristics of an OEL are: DC low voltage driven, high luminance, high efficiency, high contrast value and light. In addition, an OEL is capable of producing a spectrum of colors including the three primary colors red (R), green (G), blue (B) as well as white. Hence, OEL has the greatest potential to become the dominant type on the next generation of flat panel displays. Aside from being thin, light, energy-saving, self-illuminating and having a high resolution, a device fabricated using the OEL technique also has a wide viewing angle, a brilliant color contrast and relatively low cost of production. With these advantages, it has been broadly applied as a LCD or backlight in an indicator panel, a mobile phone, a digital camera and a personal digital assistant (PDA).

According to the driving method, OEL can be classified into passive matrix driven type and active matrix driven type. A passive matrix driven OEL has a rather simple structure and does not require any thin film transistor (TFT) to drive the circuit and hence has a lower production cost. However, the passive matrix OEL has only moderate resolution and poor displaying capacity. Furthermore, as size of the display panel is increased, power consumption is increased and working life is shortened. On the other hand, active matrix OEL technique can be applied to form a large display screen with a wider viewing angle, a higher illumination and a quicker response. The only drawback is that it has a higher production cost than a passive matrix OEL.

OEL display panels are formed generally by first forming (e.g., by a lithography and deposition process) the drive circuits comprising the necessary scan and data lines and electronic devices (e.g., switching transistors), and then forming the organic functional layer (e.g., by a lithography and deposition or coating process). FIG. 1 is a circuit diagram of the driving circuit of a conventional pixel of the OEL display. As shown in FIG. 1, before forming the organic functional layer (the location of the organic functional layer is symbolically represented by the circle 102 in FIG. 1), the pixel circuit 10 includes a scan line 104, a data line 106, a switching transistor 108, a driving transistor 110 and a capacitor 112. Since a source terminal of the driving transistor 110 is in an open circuit condition before forming the organic functional layer, it is impossible to test the performance of the circuit, such as by measuring the charge, voltage or current flowing through the driving transistor 110 via the drain terminal of the driving transistor 110. In other words, all the components inside the pixel circuit 10 can only be tested after forming the organic functional layer in a conventional pixel testing method. This is undesirable because the testing procedure is proceeded after the formation of the organic functional layer and the cathode. Therefore, the yields and the cycle time of the active matrix OEL display panels are difficult to control.

SUMMARY OF THE INVENTION

Accordingly, the present invention is to provide a active matrix organic electro-luminescent display (AM-OEL display), a electronic system comprising the AM-OEL display and a testing method that facilitate testing of the AM-OEL display prior to the formation of an organic functional layer. In one aspect of the present invention, the AM-OEL display comprises a substrate, an pixel circuit disposed over the substrate, a plurality of pixel electrodes disposed over the substrate, wherein each pixel electrode is driven by the pixel circuit, a plurality of testing components (e.g., a capacitor) electrically coupled to the pixel circuit, wherein each testing component provides a load to one of the pixel electrodes to measure a signal, which is input to each pixel electrode, an organic functional layer disposed over the substrate, and a conductive layer disposed over the organic functional layer.

In accordance with one embodiment of the present invention, the pixel circuit comprises a plurality of scan lines disposed over the substrate, a plurality of data lines disposed over the substrate, and a plurality of driving units disposed over the substrate, each driving unit is driven by one of the scan lines and one of the data lines respectively. In alternative embodiments of the present invention, the testing components are, for example, capacitors electrically coupled by the scan lines and the pixel electrodes, the data lines and the pixel electrodes, or the common lines and the pixel electrodes.

In accordance with one embodiment of the present invention, the testing components of the type that stores electric charges when the pixel circuits are activated, and discharges stored electric charges when the pixel circuits are deactivated.

In another aspect of the present invention, an electronic system comprising the AM-OEL display mentioned above is provided.

In still another aspect of the present invention, a testing method is provided. The method of testing the functionality of a pixel circuit for an AM-OEL display comprising an organic functional layer, which is driven by a plurality of pixel electrodes electrically electrically connected to the pixel circuit and a conductive layer, the method comprises operatively coupling the testing components to the pixel circuit, wherein each testing component provides a load to one of the pixel electrodes to measure a signal, which is input to each pixel electrode in the absence of the organic functional layer. Then, the pixel circuit in the absence of the organic functional layer is activated. Afterward, the pixel circuit is deactivated. Ultimately, the functionality of the pixel circuit is tested.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

Figure 1:
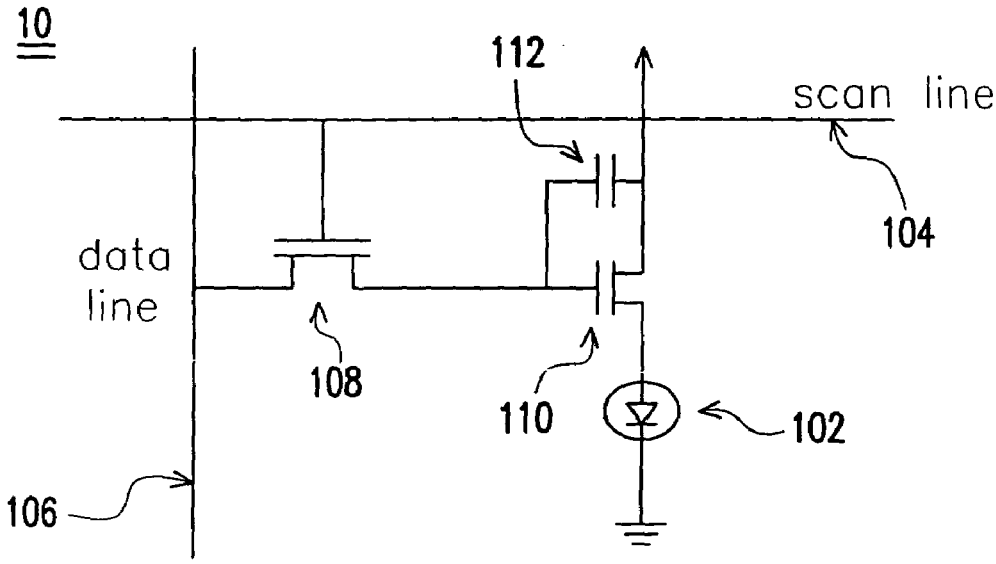
FIG. 1 (PRIOR ART)
FIG. 1 is a circuit diagram of the pixel circuit of a conventional OEL display.

Reference will now be made in detail to the present embodiments of the invention, examples of which are illustrated in the accompanying drawings. Wherever possible, the same reference numbers are used in the drawings and the description to refer to the same or like parts.

The concept of the present invention is described below in reference to pixel circuits of OEL display panels. It is understood that the present invention may be applied to other types of pixel display panels without departing from the scope and spirit of the present invention.

Figure 2:
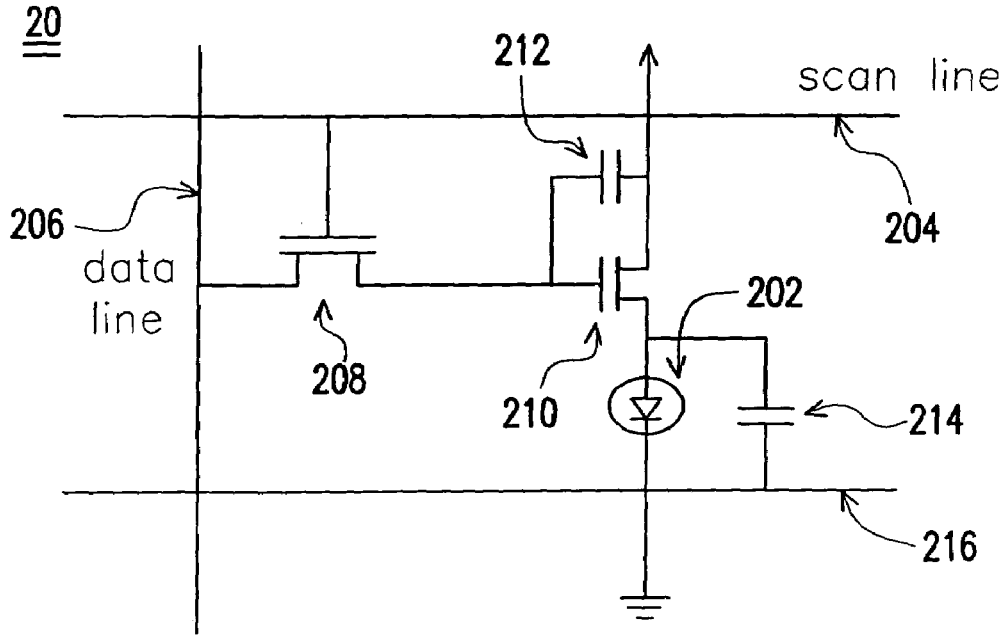
FIG. 2 is a circuit diagram of the pixel circuit of an OEL display having an organic functional layer according to a first embodiment of this invention.

A pixel testing method proposed in the present invention is adapted to measure the component parameters of the pixels within an organic electroluminescence (OEL) display before forming an organic functional layer. The OEL display comprises a pixel circuit having a plurality of scan lines and data lines for driving the pixels within the display. FIG. 2 is an equivalent circuit diagram of the pixel circuit of an OEL display, in which the location of the organic functional layer that will be eventually formed is represented by circle 202 according to a first embodiment of this invention. In FIG. 2, only a portion (one pixel) of the pixel circuit is shown. As shown in FIG. 2, the pixel circuit 20, for example, includes a plurality of scan lines 204, a data lines 206, a plurality of pixel electrodes (not shown), a plurality of driving units, a plurality of testing components, such as second capacitors 214, and a plurality of common lines 216. In an embodiment of the present invention, each driving unit includes a switching transistor 208, a driving transistor 210 and a first capacitor 212. A source terminal of the driving transistor 210 is in an open-circuit state before forming an organic functional layer (represented by circle 202).

The pixel testing method of the embodiment of the invention includes forming the common lines 216 in the pixel circuit 20, wherein each common line 216 is located below a row of pixel electrodes (not shown). In an alternative embodiment, the common line 216 is a metallic line. Thereafter, the capacitor 214 is formed between the source terminal of the driving transistor 210 (i.e. pixel electrodes) and the common line 216. One terminal of the capacitor 214 connected to the source terminal of the driving transistor 210 and is, for example, an anode (i.e. pixel electrodes of the pixel circuits) of the OEL device. Another terminal of the capacitor 214 is connected to the common line 216. The capacitor 214 is fabricated, for example, by covering the common line 216 with a layer of indium-tin oxide (ITO) material. When a voltage applied to the scan line 204 turns on the switching transistor 208 and a voltage applied to the data line 206 is greater than a threshold voltage of the driving transistor 210, the driving transistor 210 is turned on and the capacitor 214 is gradually charged. When the pixel 20 is turned off, the capacitor 214 discharges to a drain terminal of the driving transistor 210, which is a terminal for the pixel testing method. According to the measurement at the drain terminal of the driving transistor 210, some component parameters can be determined by measuring the values of charges, a voltage or a current flowing through the driving transistor 210. Accordingly, the capacitor 214 provides a load for activating the pixel circuit, whereby certain performance parameters can be tested upon deactivating the pixel circuit.

Figure 3:
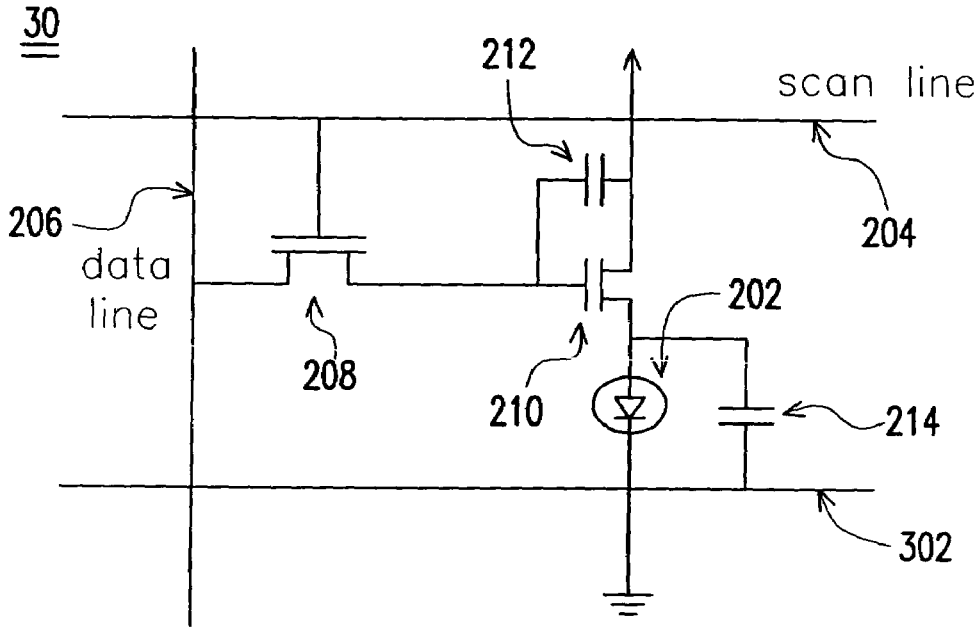
FIG. 3 is a circuit diagram of the pixel circuit of an OEL display having an organic functional layer according to a second embodiment of this invention.

FIG. 3 is an equivalent circuit diagram of the pixel of an OEL display having an organic functional layer according to another embodiment of the present invention. The pixel circuit 30 in FIG. 3 is almost identical to the pixel circuit 20 in FIG. 2, except that no additional common line is formed. Instead of forming the common line, the capacitor 214 is formed between the source terminal of the driving transistor 210 and another scan line 302 in the display. In the embodiment, one terminal of the capacitor 214 is coupled to the scan line 302 of the display, in an alternative embodiment, the terminal of the capacitor 214 can connect with the scan line 204 or one of the other scan lines in the display.

Figure 4:
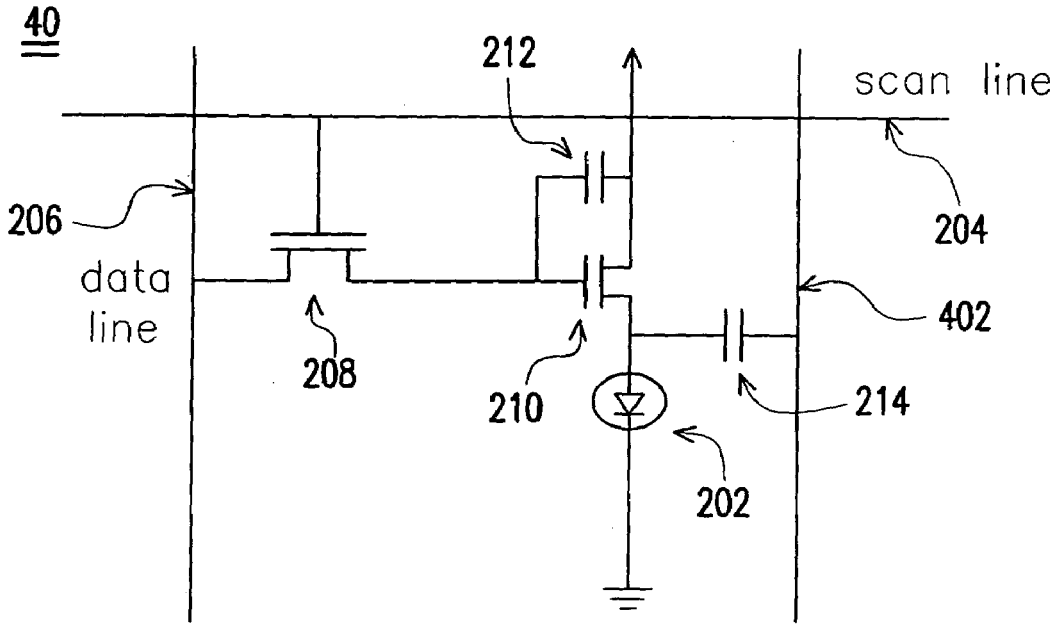
FIG. 4 is a circuit diagram of the pixel circuit of an OEL display having an organic functional layer according to a third embodiment of this invention.

FIG. 4 is an equivalent circuit diagram of the pixel of an OEL display having an organic functional layer according to a further embodiment of this invention. The pixel circuit 40 in FIG. 4 is almost identical to the pixel circuit 20 in FIG. 2, except that the capacitor 214 is formed between the source terminal of the driving transistor 210 and another data line 402 in the display. In the embodiment, one terminal of the capacitor 214 is coupled to the data line 402 of the display, in an alternative embodiment, the terminal of the capacitor 214 can connect with the data line 206 or one of the other data lines in the display.

Accordingly, one aspect of this invention is forming a capacitor, a terminal of which connects to a source terminal of a driving transistor within a pixel, and another terminal of which connects to a common line, a scan line or a data line within a display. The terminal of the capacitor connected to the source terminal of the driving transistor also connects to an electrode (for example, the anode) of an organic functional layer within the pixel. Furthermore, component parameters including charges, voltage or current of components within the pixel can be determined before the lighting device is plated. Hence, the performance of each pixel within the display can be determined by comparing with an averaging value of all of the pixels in the display.

In summary, the testing method of the present invention is used to test the functionality of an active matrix driving circuit for an AM-OEL display as mentioned above. Thus, all the components within the pixel can be measured before forming the organic functional layer in every pixel.

Figure 5:
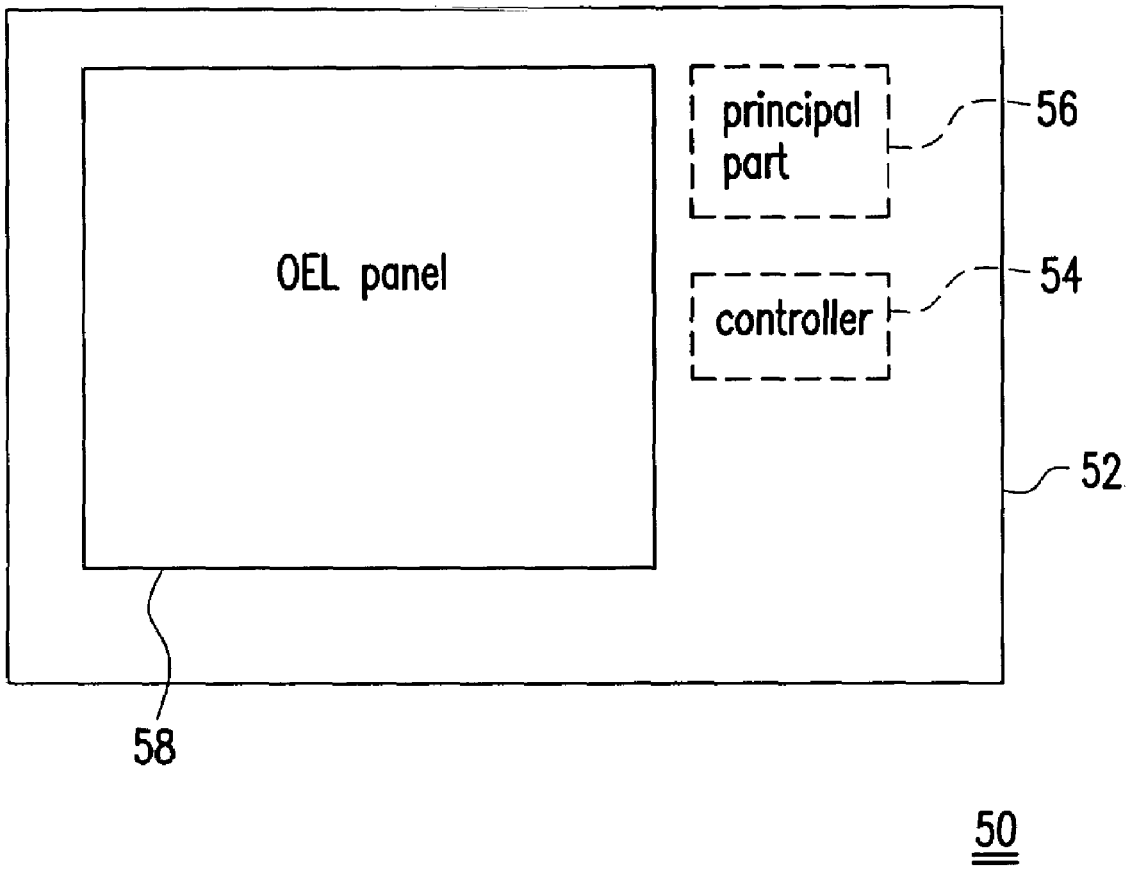
FIG. 5 is a schematic diagram of an electronic system that comprises a display panel incorporating the novel pixel circuit, in accordance with one embodiment of the present invention.

FIG. 5 is an electronic system comprising the OEL display mentioned in FIG. 2 ~FIG. 4 according to a further embodiment of this invention. The electronic system 50, for example, comprises a housing 52, a controller 54, a principal part 56 of the electronic system 50, and an OEL display panel 58 mentioned in FIG. 2~FIG. 4. However, the elements of the electronic system 50 described above is not limited the scope of the present invention.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An active matrix organic electro-luminescent display (AM-OEL display), comprising:

a substrate;

a pixel circuit disposed over the substrate;

a plurality of pixel electrodes disposed over the substrate, wherein each pixel electrode is driven by the pixel circuit;

a plurality of testing components electrically coupled to the pixel circuit, wherein each testing component provides a load to one of the pixel electrodes to measure a signal, which is input to each pixel electrode;

an organic functional layer disposed over the substrate; and a conductive layer disposed over the organic functional layer.

2. The AM-OEL display as in claim 1, wherein the pixel circuit comprises:

a plurality of scan lines disposed over the substrate;

a plurality of data lines disposed over the substrate; and a plurality of driving units disposed over the substrate, each driving unit is driven by one of the scan lines and one of the data lines respectively.

3. The AM-OEL display as in claim 2, wherein the testing components comprise capacitors, which are electrically coupled by the scan lines and the pixel electrodes.

4. The AM-OEL display as in claim 2, wherein the testing components comprise capacitors, which are electrically coupled by the data lines and the pixel electrodes.

5. The AM-OEL display as in claim 2, further comprising a plurality of common lines disposed over the substrate, wherein each common line is located between two adjacent scan lines.

6. The AM-OEL display as in claim 5, wherein the testing components comprise capacitors, which are electrically coupled by the common lines and the pixel electrodes.

7. The AM-OEL display as in claim 1, wherein the testing components of the type that stores electric charges when the pixel circuit are activated, and discharges stored electric charges when the pixel circuit are deactivated.

8. The AM-OEL display as in claim 1, wherein each testing component comprises a capacitor.

9. An electronic system comprising the AM-OEL display as in claim 1.

10. A method of testing the functionality of a pixel circuit for an AM-OEL display comprising an organic functional layer, which is driven by a plurality of pixel electrodes electrically connected to the pixel circuit and a conductive layer, the method comprising:

operatively coupling the testing components to the pixel circuit, wherein each testing component provides a load to one of the pixel electrodes to measure a signal, which is input to each pixel electrode in the absence of the organic functional layer;

activating the pixel circuit in the absence of the organic functional layer;

deactivating the circuit components; and testing the functionality of the pixel circuit.

11. The method as in claim 10, wherein the testing components comprise capacitors.

12. The method as in claim 10, wherein the testing components comprise capacitors formed by electrically coupling by a plurality of scan lines and a plurality of pixel electrodes.

13. The method as in claim 10, wherein the testing components comprise capacitors formed by electrically coupling by a plurality of data lines and a plurality of pixel electrodes.

14. The method as in claim 10, wherein the testing components comprise capacitors formed by electrically coupling by a plurality of common lines and a plurality of pixel electrodes.

* * * * *